United States Patent [19]

Suzuki

[11] 4,128,079

[45] Dec. 5, 1978

[54] MOUNTING APPARATUS FOR A DRUM AND DEVELOPING ROLL IN A DEVELOPING UNIT OF MAGNETIC BRUSH TYPE

[75] Inventor: Minoru Suzuki, Yokohama, Japan

[73] Assignee: Ricoh Company, Ltd., Tokyo, Japan

[21] Appl. No.: 824,294

[22] Filed: Aug. 15, 1977

[30] Foreign Application Priority Data

Aug. 18, 1976 [JP] Japan ..... 51-110426
Oct. 20, 1976 [JP] Japan ..... 51-125907

[51] Int. Cl.[2] ..... G03G 15/09
[52] U.S. Cl. ..... 118/658
[58] Field of Search ..... 118/627, 656, 657, 658, 118/653

[56] References Cited

U.S. PATENT DOCUMENTS

| | | | |
|---|---|---|---|
| 3,358,637 | 12/1967 | Shearer | 118/658 |
| 3,628,504 | 12/1971 | Richmond | 118/656 X |
| 3,823,688 | 7/1974 | Klett | 118/658 |
| 3,894,513 | 7/1975 | Stanley et al. | 118/658 X |
| 3,999,514 | 12/1976 | Abbott et al. | 118/657 |
| 4,026,241 | 5/1977 | Takebe et al. | 118/658 X |
| 4,033,294 | 7/1977 | Charland et al. | 118/658 |
| 4,041,901 | 8/1977 | Rarey et al. | 118/658 X |

*Primary Examiner*—Werner H. Schroeder
*Assistant Examiner*—Andrew M. Falik
*Attorney, Agent, or Firm*—Cooper, Dunham, Clark, Griffin & Moran

[57] ABSTRACT

A developing unit of magnetic brush type for use in an electrophotographic copying machine comprises a casing, a magnet mounted on said casing and disposed in parallel relationship with a central axis of rotation of a photosensitive member in the form of a drum, and a sleeve which surrounds the magnet and on which a magnetic brush is to be formed. The unit also comprises another or second central axis of rotation associated with the magnetic brush represented by a mounting shaft for the magnet which has its opposite ends projecting out of the casing. A first positioning member, on which is detachably fitted on one end of the mounting shaft representing the second central axis of rotation and having a support aperture for supporting said one end, and a second positioning member detachably fitted on a drum shaft on the first central axis of rotation, has a support aperture formed therein for detachably fitting on the other end of the magnet mounting shaft to support it. The arrangement permits precise positioning of the magnetic brush with respect to the drum to be simply achieved.

15 Claims, 6 Drawing Figures

MOUNTING APPARATUS FOR A DRUM AND DEVELOPING ROLL IN A DEVELOPING UNIT OF MAGNETIC BRUSH TYPE

BACKGROUND OF THE INVENTION

The invention relates to an electrophotographic copying machine, and more specifically, to a developing unit of the magnetic brush type for use in an electrophotographic copying machine of the kind in which an electrostatic latent image is formed on a drum surface in accordance with the image of an original and is then developed with a developer.

A developing unit of magnetic brush type essentially comprises a magnet, a sleeve surrounding the magnet and a developer. A magnetic brush comprising the developer is formed on the outer peripheral surface of the sleeve and is brought into rubbing contact with a drum surface to develop an electrostatic latent image formed on the drum surface. Of significance in an electrophotographic copying machine with magnetic brush developing is the relative positional relationship between the drum surface on which the latent image is formed and the developing unit or more specifically the magnetic brush, which relationship has a great influence upon the image quality of a copy obtained. Specifically, the spacing between the drum and the magnetic brush must be maintained constant along the length of the central axis of rotation, otherwise a non-uniformity is produced in the optical density of the resulting image.

On the other hand, the drum and/or developing unit is frequently disassembled from the body of the copying machine for the purpose of maintenance and inspection of these components as well as other devices which are associated with them. Thus, there must be some provision to assure a uniform spacing between the drum and the magnetic brush when these components are assembled together again.

The spacing between the drum and the magnetic brush is usually adjusted by moving the magnetic brush toward or away from the drum. However, because the adjustment is referenced to a side plate of the developing unit or outer walls of the copying machine, the reference of the adjustment varies from machine to machine. This implies that when a developing unit is replaced by a fresh one, the spacing between the drum and the brush must be adjusted again. The same discussion applies to a developing unit in which a plurality of magnetic brushes are formed. In this instance, the individual magnetic brushes have to be adjusted in order to maintain a given spacing between the individual brushes and between each brush and the drum. This requires a considerable length of time for the maintenance and inspection of the machine.

SUMMARY OF THE INVENTION

In accordance with the present invention, there is provided a developing unit of magnetic brush type in which the spacing between a drum and a magnetic brush is maintained constant by the use of positioning members which fit on a central axis of rotation of the drum and another central axis of rotation which is associated with the magnetic brush. The unit comprises a casing for mounting a magnetic disposed in parallel relationship with the central axis of rotation of the drum, and a sleeve which surrounds the magnet. In addition, the unit comprises shaft means representing a second central axis of rotation which is associated with the magnetic brush and which has its opposite ends projecting out of the casing, a first positioning member detachably fitted on one end of the shaft means representing the central axis of rotation associated with the magnetic brush and having a support aperture for supporting this end, a second positioning member detachably fitted on shaft means representing the central axis of rotation of the drum, and a support aperture formed in the second positioning member and detachably fitted on the other end of the shaft means representing the central axis of rotation associated with the magnetic brush for supporting said other end.

Therefore, it is an object of the invention to provide a developing unit of magnetic brush type in which the spacing between the drum and magnetic brush can be maintained constant without requiring any adjustment, by providing positioning members which fit on the central axes associated with the drum and the brush, respectively.

It is another object of the invention to provide a developing unit of magnetic brush type and having a plurality of magnetic brushes in which the spacing between the individual brushes and the drum can be maintained constant, by disposing the central axes of rotation associated with the respective magnetic brushes in a manner radially displaceable with respect to bearings mounted on the casing.

DETAILED DESCRIPTION OF PREFERRED EMBODIMENTS

Figure 1:
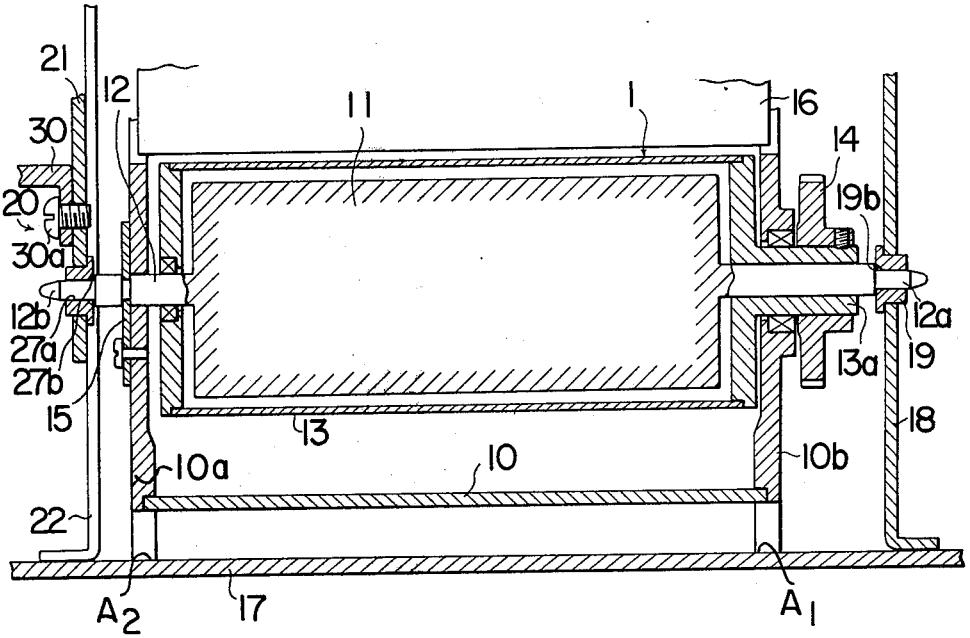
FIG. 1 is an elevational section of one embodiment of the invention.

Referring to FIG. 1, there is shown a developing unit which is generally designated by numeral 1. Unit 1 includes a casing 10 having a pair of opposite side plates **10*a*, 10*b*, between which a magnet 11 is journalled by a shaft 12 representing the central axis of rotation of the magnetic brush which it forms. The magnet 11 is surrounded by a sleeve 13, on which the magnetic brush is formed and which is rotatable with respect to the magnet 11. At its right-hand end, the sleeve 13 is formed with a hollow shaft 13*a* on which a gear 14 is fixedly mounted. The gear 14 is adapted to be driven for rotation by drive means, not shown, to rotate the sleeve. The magnet 11 is locked against rotation by a locking device 15 on side plate 10*a*. As the sleeve 13 rotates, a magnetic brush is formed on the peripheral surface thereof by developer in the bottom of the casing 10. The opposite ends 12*a*, 12*b* of the shaft 12 representing the central axis of rotation of the magnetic brush project out of the side plates 10*a*, 10*b* of the casing 10 to be supported by positioning members to be described later. It will be noted that the ends 12*a*, 12*b* are tapered. Numeral 16 indicates a photosensitive member in the form of a drum and 17 a bottom plate of the copying machine on which the unit 1** is supported. It is to be understood and explained below that the entire developing unit can be withdrawn from the machine by moving it to the left, as viewed in FIG. 1.

Figure 2:
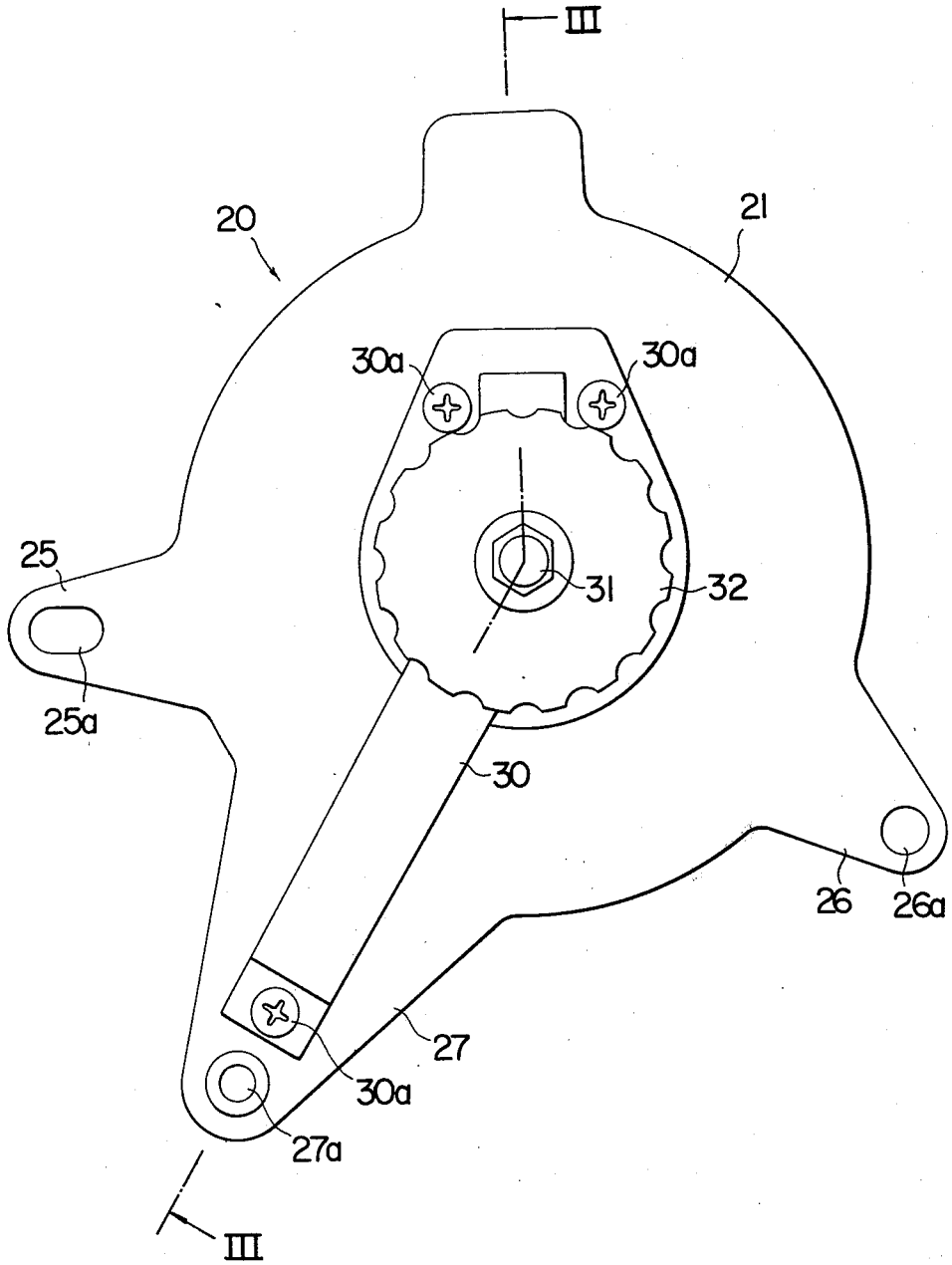
FIG. 2 is a front view of a second positioning member used in the unit of the invention.
Figure 3:
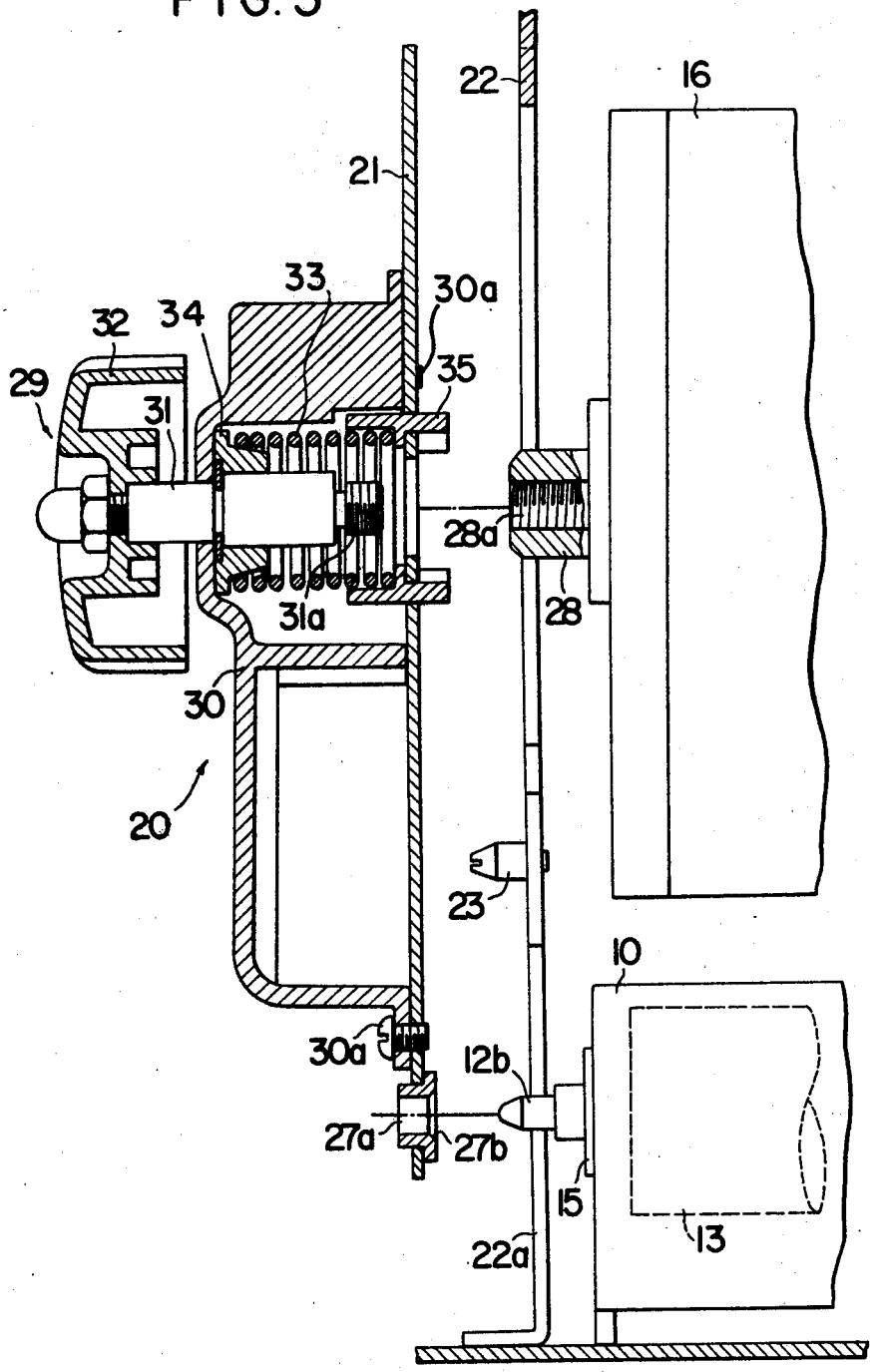
FIG. 3 is a fragmentary section of the unit according to the invention taken along the lines III—III in FIG. 2.
Figure 4:
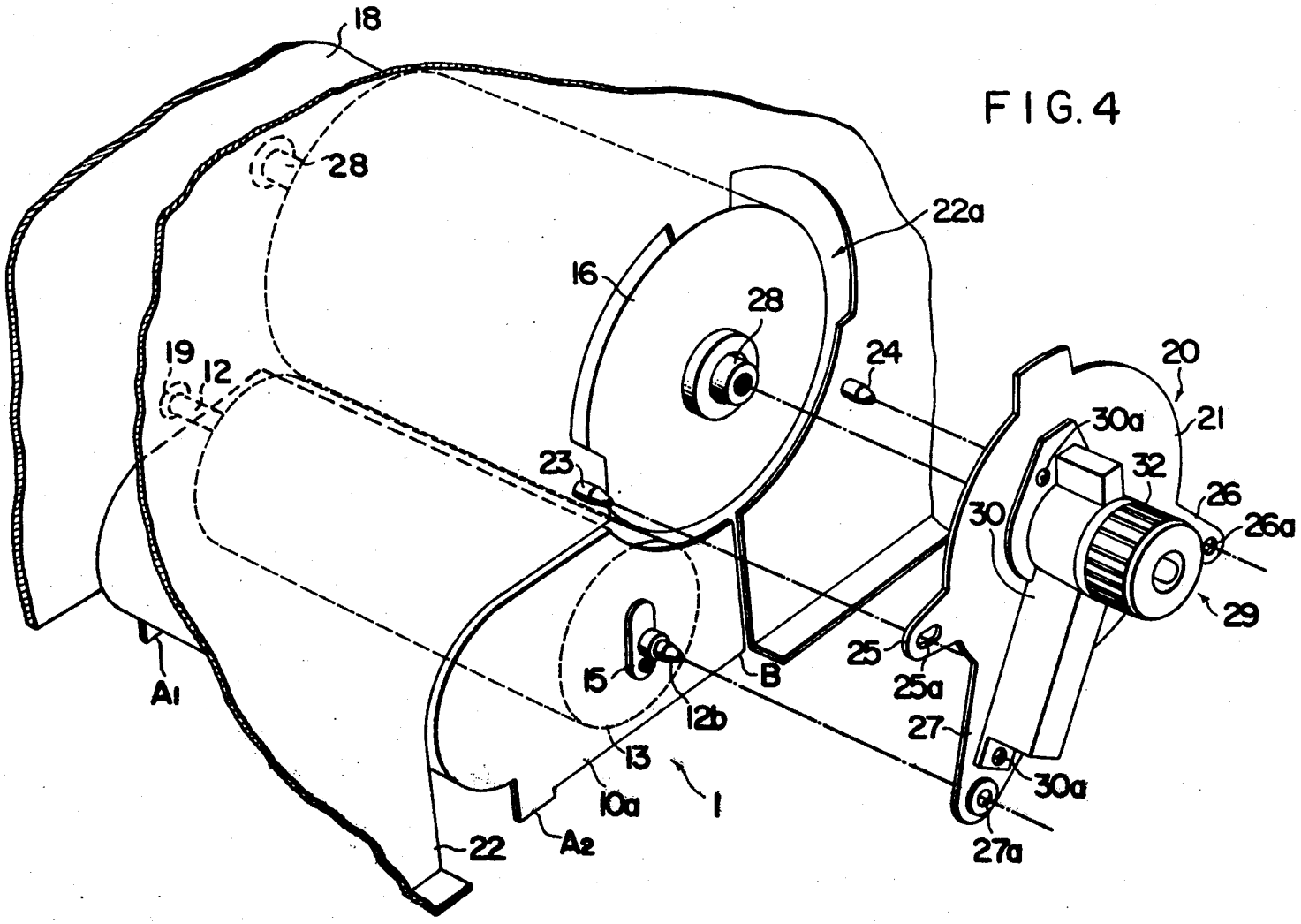
FIG. 4 is a perspective view illustrating the positioning operation of the invention.

The end 12*a* of the central axis 12 is fitted into a support aperture 19*a* having a bevelled edge 19*b* formed in a first positioning member 19 which is secured to a side plate 18 which is in turn fixedly mounted on the copying machine. The other end 12*b* is fitted into a support aperture 27*a* formed in a second positioning member 20 shown in detail in FIGS. 2–4. The second positioning member 20 comprises a body 21, and positioning arms 25, 26 each having an opening 25*a*, 26*a* for engagement with positioning pins 23, 24 (see FIG. 4) fixedly mounted on a side plate 22 which is disposed opposite and parallel to the other side plate 18 and also secured to the copying machine. Additionally the member 20 comprises a support arm 27 having the support aperture 27*a* formed therein for receiving the end 12*b* of the central axis shaft 12 associated with the magnetic brush, means 29 for mounting the member 20 on a shaft 28 representing the central axis of rotation of the drum 16, and a support member 30 for the mounting means 29. The aperture 27*a* has a bevelled edge 27*b* to facilitate reception of the tapered end 12*b* of shaft 12. As shown in FIG. 3, the mounting means 29 includes a stub shaft 31 adapted to be detachably fitted into the support member 30 and having an inner end 31*a* which is threaded for engagement with a threaded bore 28*a* formed in the end of the central axis of rotation shaft 28, a knob 32 secured to the outer end of the stub shaft, a compression spring 33 disposed on the stub shaft, a spring abutment 34 and a shoe 35. The support member 30 is secured to the body 21 by means of set screws 30*a*. Both the drum 16 and the developing unit 1 can be moved into and out of the copying machine through an opening 22*a* formed in the side plate 22 of the machine, as shown in FIG. 4.

In operation, the end 12*a* of the shaft 12 is first fitted into the support aperture 19*a* formed in the first positioning member 19 that is secured to the side plate 18. At this time the drum 16 is suspended above, the casing 10 of the developing unit 1 and the casing 10 is out of alignment with the drum 16 and bears against the bottom plate 17 at three points, namely points A1, A2 and B (see FIG. 4). Then the second positioning member 20 is mounted in place over the shaft 28 and, engaging the openings 25*a*, 26*a* with the positioning pins 23, 24. The casing 10 is pivoted about points A1, A2 engaging the support aperture 27*a* in the positioning arm 27 with the opposite end 12*b* of the central axis shaft 12. With the parts thus appropriately aligned and loosely held in positioning member 20, the knob 32 is then turned to engage the threaded portion 31*a* (see FIG. 3) with the central axis shaft 28 of the drum to tighten the arrangement. The point B of the casing 10 will have then been raised, and sleeve 13 and drum 16 brought into and fixed in axial alignment with each other, with the developing unit 1 supported by the central axis shaft 12 and the points A1 and A2. Simultaneously with the tightening of portion 31*a*, in bore 28*a* relative movement in the axial direction between the drum 16 and the developing unit 1 is constrained. With the described arrangement, the spacing between the drum and the magnetic brush or more specifically the sleeve 13 on which a brush is to be formed can be maintained constant, achieving ready interchangeability of the developing units. Since a constant spacing is obtained by merely securing the positioning members in place, the need for a complex adjustment which has heretofore been experienced during the maintenance and inspection of the copying machine is eliminated, permitting a simple dismounting and assembly of the drum and the developing unit for repair and inspection purposes.

Where a throughput of copies per unit time is to be increased, a developing unit having a plurality of magnetic brushes is used in order to accommodate for an increase in the copying speed. Such developing unit is referred to as a multiple brush developing unit. When the invention is applied to such a multiple brush developing unit, a mere increase in the number of support apertures formed in the positioning members does not achieve the intended purpose. Specifically, when a plurality of magnetic brushes are to be provided, it is a relatively simple matter to form an increased number of apertures with good accuracy, but the mounting of the corresponding sleeves must be achieved with high accuracy. Otherwise, an impediment will occur to the rotation of the individual magnetic brushes, resulting in a copy of poor quality. In addition, when a uniform accuracy is to be achieved for all of the developing brushes, an increase in the cost results. On the other hand, if the mounting position of the individual sleeves varies from brush to brush, interchangeability of the developing units between copying machines is lost.

In accordance with another aspect of the invention, a freedom is permitted for the sleeve to be radially displaceable as it is mounted on the casing, thereby enabling a positioning of a magnetic brush with respect to the drum with high accuracy and in a simple manner even if a plurality of magnetic brushes are to be provided.

Figure 5:
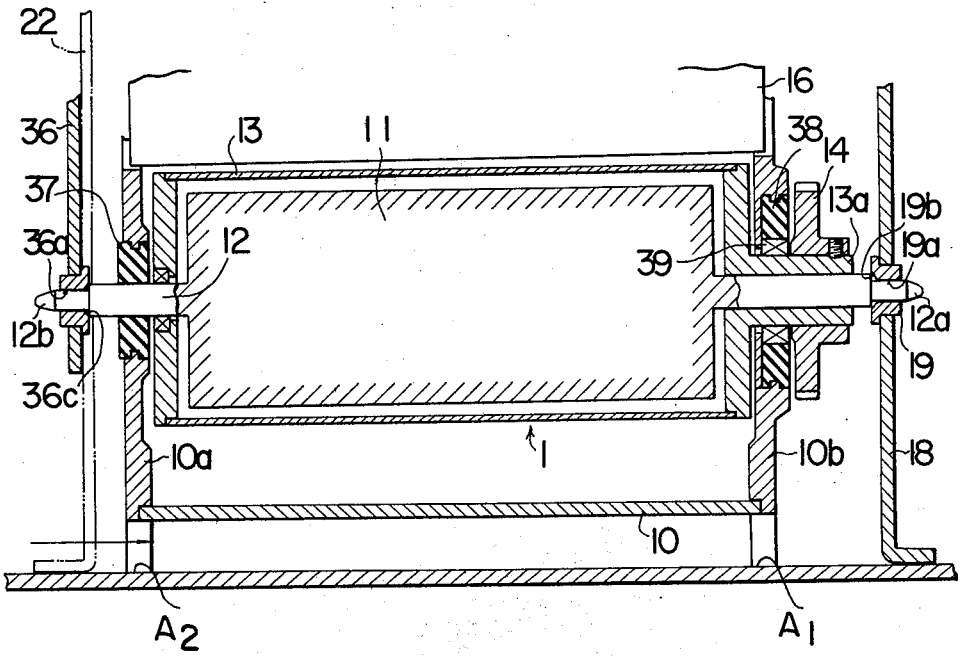
FIG. 5 is an elevational section of another embodiment of the invention.
Figure 6:
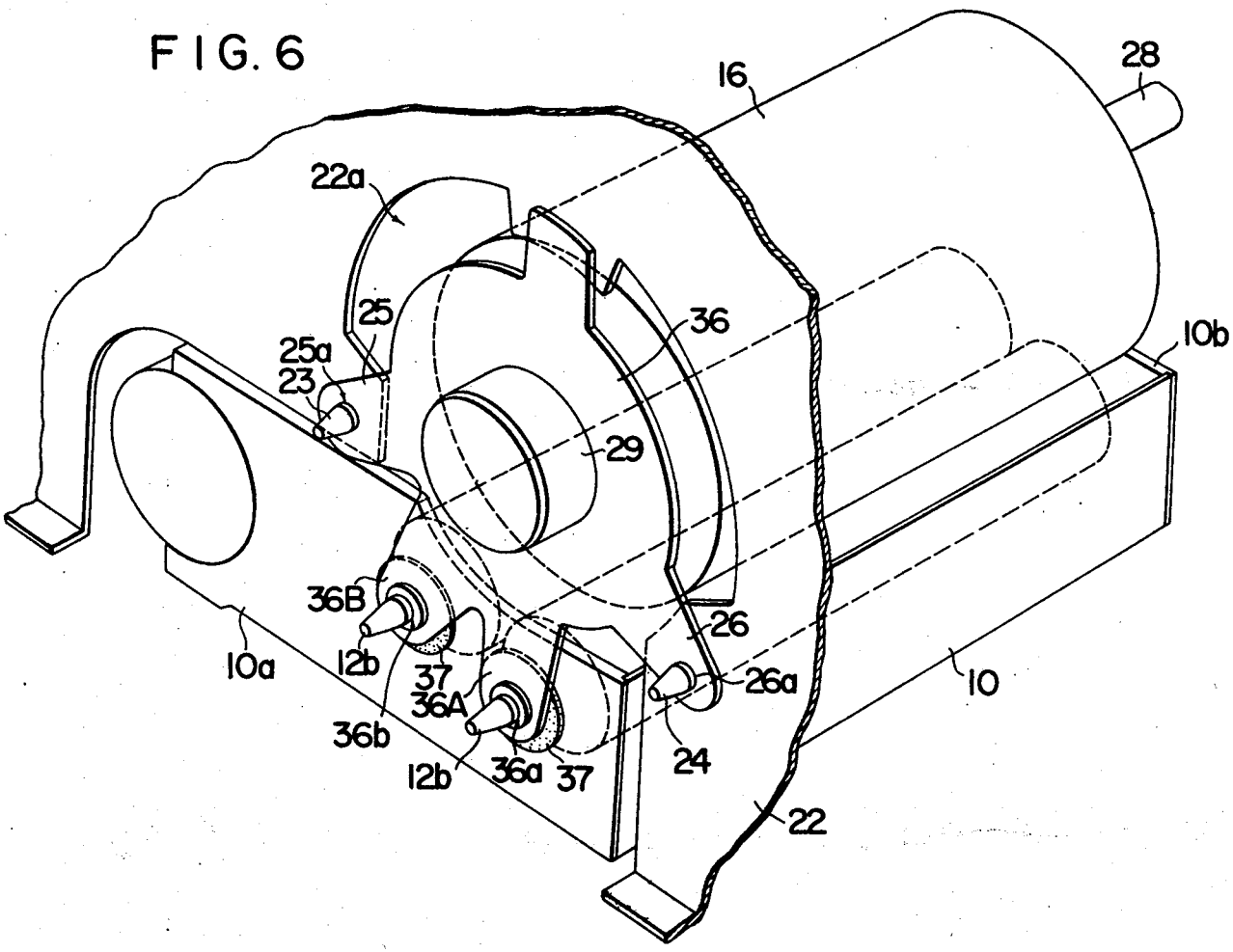
FIG. 6 is a perspective view of the embodiment shown in FIG. 5.

Referring to FIGS. 5 and 6, another embodiment of the invention will be described. It is to be understood that similar parts as those described above in connection with FIGS. 1 to 4 are designated by like reference characters and will not be repeatedly described. FIG. 5 shows an embodiment of the invention which can be advantageously used for a copying machine having a plurality of magnetic brushes. In FIG. 5, only one of these magnetic brushes is illustrated but FIG. 6 shows two such brushes, in perspective, mounted on the casing. The shaft 12 which represents the axis of rotation of the magnetic brush is supported by the casing by means of bearings 37, 38 which are mounted in the side plates 10*a*, 10*b*. These bearings 37, 38 are formed of elastic members such as rubber or rubber-like materials. One of the bearings, 37, supports the end 12*b* of the shaft while the other bearing, 38, supports the hollow shaft 13*a* of the sleeve 13 through roller bearing 39. In this manner, the magnetic brush to be formed on the sleeve is radially displaceable by supporting the shaft 12, which represents its axis of rotation, on the casing through the interposition of elastic members.

A second positioning member 36 is generally similar to the second positioning member 20 mentioned above in that it includes mounting means 29 and positioning openings 25*a*, 26*a*, the latter preventing a rotation of the positioning member about the shaft 28 which represents the axis of rotation of the drum 16. However, the member 36 differs from the previous positioning member 20 in that it includes a plurality of the positioning arms as shown at 36A, 36B in FIG. 6, each of the positioning arms being formed with a support aperture 36*a*, 36*b* for supporting the shafts of the respective magnetic brushes. Each of the support apertures 36*a*, 36*b* has a bevelled edge 36*c* (see FIG. 5) adjacent the corresponding magnetic brush. It is to be understood that the shafts 12 of the respective magnetic brushes are locked against rotation by means, not shown. The removal and assembly of the developing unit thus constructed out of and into the copying machine as well as the positioning operation are similar to those described above, and hence will not be described.

When the opposite ends of each shaft 12 are fitted into the first and second positioning members 19, 36, the magnetic brush which is supported on the casing 10 through the interposition of elastic members will assume a radial position which is determined by the support apertures 19*a*, 36*a*, 36*b* in the individual positioning members. Thus, the position of each shaft 12 of the individual magnetic brushes is not constrained by the bearings through which it is mounted on the casing, but is determined by both positioning members, avoiding any loading upon rotation of the sleeve 13.

In the embodiment shown in FIG. 5, an elastic member has been interposed between the shaft 12 and the side plate of the casing to permit a radial movement of the magnetic brush. However, such elastic member may be omitted and the shaft 12 allowed to be directly supported by a bore in the side plate of the casing which serves as a bearing. It is to be understood that the shaft 12 will be again radially movable within the bore.

As discussed above, in the developing unit of the present invention, a sleeve on which a magnetic brush is formed is radially movable with respect to the body of the developing unit, and the positioning of the magnetic brush with respect to the drum can be simply and rapidly achieved by providing a first positioning member which remains stationary and a second positioning member which engages the drum, both of which control the position of the magnetic brush. In addition, with the arrangement of the invention, the spacing between the magnetic brush and the drum can be maintained constant while requiring the accuracy only for the location of the support apertures in the positioning members. This means that a high accuracy is not required for the mounting of the sleeves onto the casing, thus allowing a reduction in the cost of the developing unit.

What is claimed is:

1. A developing unit of magnetic brush type comprising:

a casing means for holding developer;

a magnet disposed in said casing means;

means, disposed in parallel relationship with said casing means, for defining a first central axis of rotation of a photosensitive member in the form of a drum, said defining means comprising two ends extending from the opposite sides of said drum;

a rotatable sleeve means for surrounding the magnet;

means for mounting said magnet and sleeve means on a second central axis of rotation of a magnetic brush to be formed on the sleeve means, said mounting means being supported on the casing means and having opposite ends projecting out of the casing means;

a fixed, first positioning means, detachably receiving one of said two ends of said defining means and one of said opposite ends of said mounting means in respective support apertures therein, for supporting said one end at a predetermined distance from each other;

a stationary member; and a second positioning means, detachably fitted on the other of said two ends of said defining means and having a support aperture detachably receiving the other of said opposite ends of said mounting means on the second central axis of rotation associated with the magnetic brush, for supporting said other ends at said predetermined distance from each other on said stationary member.

2. A developing unit according to claim 1 in which the opposite ends of said mounting means are tapered.

3. A developing unit according to claim 1 in which the second positioning means comprises means for preventing axial withdrawal of the positioning means from the central axis of rotation of the drum.

4. A developing unit according to claim 1 in which the second positioning means comprises means for preventing a rotation thereof about the central axis of rotation of the drum.

5. A developing unit according to claim 1 further comprising bearing means in said casing means for receiving at least one of the opposite ends of said mounting means and means for permitting said opposite end to move radially with respect to the casing means.

6. A developing unit according to claim 1 further comprising at least one more of said sleeve means on which magnetic brushes are to be formed.

7. A developing unit according to claim 1 in which at least one of the support apertures in the first positioning means comprises a bearing member.

8. A developing unit according to claim 1 in which the support aperture in the second positioning means comprises a bearing member.

9. A developing unit according to claim 3 in which said defining means further comprises a threaded bore formed in said other end extending from the drum, and said withdrawal preventing means comprises a threaded member supported by the second positioning means and adapted to engage the threaded bore, and a knob for turning the threaded member.

10. A developing unit according to claim 4 in which the rotation preventing means comprises an opening formed in the second positioning means, and further comprising a positioning pin fixedly mounted on said stationary member and adapted to engage the opening.

11. A developing unit according to claim 5 in which said movement permitting means comprises an elastic member interposed between the bearing means and the casing.

12. A developing unit according to claim 1 further comprising a plurality of said sleeve means each mounted on a respective one of said mounting means having opposite ends projecting out of the casing means.

13. A developing unit according to claim 1 further comprising a plurality of said sleeve means each mounted on a respective one of said mounting means with its respective opposite ends being engaged with and supported by support apertures in the first and second positioning means.

14. A developing unit according to claim 7 in which the opening in the bearing member is bevelled adjacent said mounting means.

15. A developing unit according to claim 8 in which the opening in the bearing member is peripherally bevelled adjacent said mounting means.

* * * * *